US006860674B2

(12) United States Patent
Solon

(10) Patent No.: US 6,860,674 B2
(45) Date of Patent: Mar. 1, 2005

(54) SPEED BUMPS FORMED FROM TIRE TREAD STRIP LAMINATIONS

(75) Inventor: Joseph J Solon, Auburn, NY (US)

(73) Assignee: Interstate Recycling, Auburn, NY (US)

( * ) Notice: Subject to any disclaimer, the term of this patent is extended or adjusted under 35 U.S.C. 154(b) by 51 days.

(21) Appl. No.: 10/329,365

(22) Filed: Dec. 27, 2002

(65) Prior Publication Data

US 2004/0123407 A1 Jul. 1, 2004

(51) Int. Cl.[7] ..... E01F 11/00
(52) U.S. Cl. ..... 404/15
(58) Field of Search ..... 404/15, 19, 32

(56) References Cited

U.S. PATENT DOCUMENTS 4,490,069 A * 12/1984 Cushman et al. ..... 404/15
4,697,294 A 10/1987 Schafer ..... 14/695
4,790,684 A * 12/1988 Adams ..... 404/16
4,801,217 A * 1/1989 Goldberg ..... 404/75
5,131,787 A * 7/1992 Goldberg ..... 404/32
5,340,630 A * 8/1994 Tripp ..... 428/54
5,364,206 A * 11/1994 Marienfeld ..... 405/16
5,392,728 A * 2/1995 Speer et al. ..... 116/63 R
5,421,668 A * 6/1995 Cowan et al. ..... 404/6
5,735,632 A * 4/1998 Braverman ..... 404/6
5,834,083 A * 11/1998 Pignataro, Jr. ..... 428/61
6,316,069 B1 * 11/2001 Bove et al. ..... 428/44

* cited by examiner

*Primary Examiner*—Gary S. Hartmann
(74) *Attorney, Agent, or Firm*—Laurence R. Brown

(57) ABSTRACT

Speed bumps for mounting across roadway lanes to encourage vehicle drivers to slow down are formed of laminated layers of elongated flexible rubber strips secured together to form a speed bump unit. Typical bump heights of three inches are obtained from six laminated half-inch layers. in one embodiment, layers not exceeding five inch widths cut from treads of discarded vehicle tires between opposing shoulders have a propensity to lie flatly upon a road surface, and are pyramided upwardly by a plurality of stepped layers of decreasing widths thus presenting inclined leading and trailing edges for intercepting the tires of oncoming moving vehicles. In another embodiment curved layers of tire tread strips form ingress and egress edges inclined gradually downward from an uppermost crown to the roadway surface for intercepting the oncoming moving vehicle tires.

1 Claim, 2 Drawing Sheets

SPEED BUMPS FORMED FROM TIRE TREAD STRIP LAMINATIONS

TECHNICAL FIELD

This invention relates to speed bumps for mounting on vehicle traffic lanes to encourage vehicle drivers to reduce speed, and more particularly it relates to construction of long life resilient speed bumps as an assembly of a plurality of elongated rubber strips, typically tire tread strips cut from discarded vehicle tires.

BACKGROUND

Speed bumps are not only costly to manufacture and mount on roadway surfaces, but additionally have limited life in their resident sites on a road surface subject to deterioration from vehicle impact, weather conditions and other environmental impact. Prior art construction techniques, for example, are not compatible with a wide range of specified road constructions including brick, asphalt and concrete surfaces, which deteriorate with weather and catastrophic damage in use. Nor can they be non-destructively removed for reuse, such as when taken up during winter seasons when surfaces freeze and when snow plows would damage them. In particular they are deficient in confronting heavy load impacts incurred from approaching heavy vehicles at high speeds without accelerated damage and deterioration.

Prior art speed bumps are primarily non-flexible attachments permanently affixed in place on previously prepared road surfaces, typically along low speed limit residential streets, to encourage passing motorists to reduce speeds. Particularly when asphalt speed bumps are affixed in place by reworking road surfaces integrally, they cannot be temporarily removed and reused in the event of later road surface improvements or during wintertime, and the cost of resurfacing the road is prohibitive.

Critical non-resilient impact surfaces for intercepting oncoming vehicle tires are subject to catastrophic failure and short life cycles, and any attempts at making impact surfaces resilient have added disproportionate costs and inconveniences to make their use impractical.

Prior art speed bump costs including material costs, handling costs, assembly costs and installation costs are excessive, particularly when complex assemblies of various units and extensive roadway modifications are encountered. The bulky size of the speed bumps make it impractical and costly to mold and handle ready to install speed bump units made from molded plastics, for example.

One prior art attempt to produce flexible speed bump parts from molded plastics such as recycled crumb rubber products members is known in the prior art as shown for example in U.S. Pat. No. 4,697,294, Oct. 6, 1987 by Hartmut Schafer for SPEED BUMPS FOR ROADWAYS. Therein a series of separate plates, including ramp plates and spacer plates are assembled together on a roadway surface in a pattern either by screwing several adjacent plates directly onto a roadway surface or by providing screwed-in-place inter plate connectors between the adjacent plates. To absorb impact from oncoming vehicle tires, the ramp plates are reinforced by metal reinforcing members cast into the ramp plates. The speed bump thus positions an elevated pattern of intermediate interconnecting elevated cast plastic plates between leading and trailing inclined wedge plates.

Deficiencies of the prior art speed bump configurations in general use include the inability to non-destructively remove the bumps ready for reuse, for example during winter conditions where frost and snow plow damage is incurred. Furthermore, non-resilient impact surfaces on the speed bumps which interface with impacting vehicle tires are subject to damage and have limited life cycles, particularly in the presence of high impact force heavy-weight vehicles such as trucks.

Also the cost of installed speed bumps, including the road surface preparation, as well as costs of the raw materials and processing of the raw materials into speed bump configurations, is critical, as well as the special construction, road preparation and maintenance costs of roadway surfaces. For example, a speed bump should be compatible for use on either asphalt or concrete roadway surfaces and must be available in various custom specified heights, lengths and widths. Thus, the in-situ construction in installing asphalt bumps on asphalt road surfaces, for example, may easily result in short life cycles, catastrophic failures and non-uniformity in meeting and controlling custom specifications that are usually demanded by the respective highway authorities.

DISCLOSURE OF THE INVENTION

The aforesaid deficiencies of the prior art speed bumps are eliminated by this invention, which provides improved performance at lower cost. Thus, the speed bumps afforded by this invention comprise an assembly of appropriate length, width and height composed of stacks of elongated rubber strips. In a preferred embodiment the rubber strips are cut from discarded tire carcasses, thus providing low cost materials and internal reinforcement inherent in steel belted tires, thereby to resiliently encounter the impact of oncoming vehicle tires thereby increasing the working life of the speed bump in service.

The speed bumps comprise a stacked assembly of elongated resilient rubber strip layers affixed together by adhesives or nails to produce ready-to-install speed bump units meeting custom specifications including width, height and width. These speed bump units manufactured to custom specifications can in turn be simply positioned upon and affixed to an existing roadway surface (either asphalt or concrete) to present an uppermost crown positioned between inclined reinforced resilient ingress and egress surfaces for intercepting overrunning vehicle tires. Adhesive surfaces or roadway penetrating nails, screws or bolts extending through the speed bump unit into the roadway surface permit non-destructive removal and reuse, such as might be required in winter times to prevent snow plow damage, all without significant roadway damage.

Other objects, features and advantages of the invention are found throughout the following specification, claims and appended drawings.

BRIEF DESCRIPTION OF THE DRAWINGS

In the accompanying drawings, wherein like reference characters relate to similar features throughout the various views to facilitate comparison.

THE PREFERRED EMBODIMENTS

Figure 1:
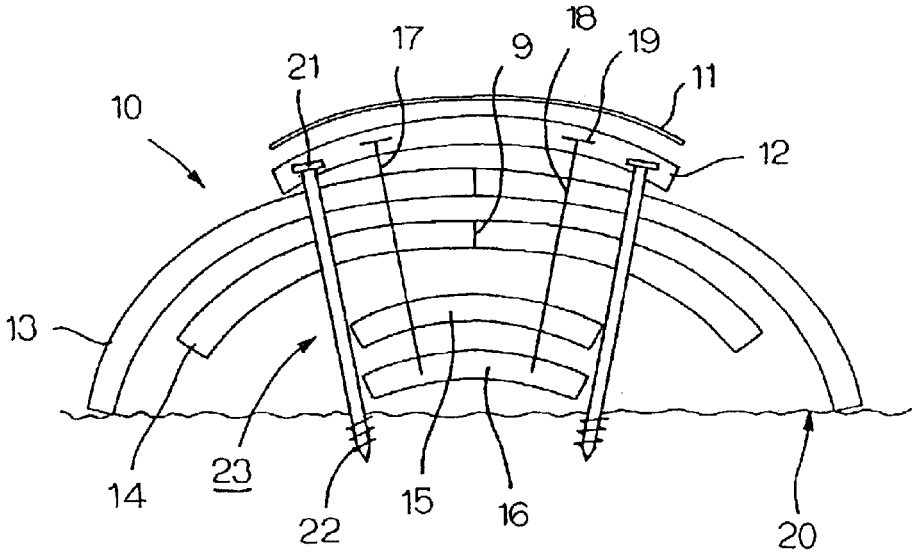
FIG. 1 is a diagrammatic end view sketch of a speed bump unit configuration formed of stacked elongated rubber strips nailed together and bolted into a roadway surface in this embodiment, in which the several layers are separated for better illustration of the constructive details.

In FIG. 1 the speed bump is formed of a plurality of layers typically one-half inch thick curved rubber strips reclaimed from discarded tire carcasses. The height of the speed bump to the uppermost crown with the shown five half-inch-thick layers thus would be two and a half inches. Bumps of greater height may be made by adding further layers. The overall width of the speed bump unit is typically about one foot, as illustrated, and greater widths may be obtained by adding side to side strips in designated assembly layers. Typically strips of three inches, four inches, six inches and twelve inches are simply cut from reclaimed tire carcasses and layers formed of side-by-side strips are illustrated at 9. In this embodiment the stack of curved tire tread strips form a speed bump unit configuration presenting a highly visible by night thin layer 11 adhered to the uppermost crown layer centered between the inclined ingress and egress regions of layer 13.

Figure 2:
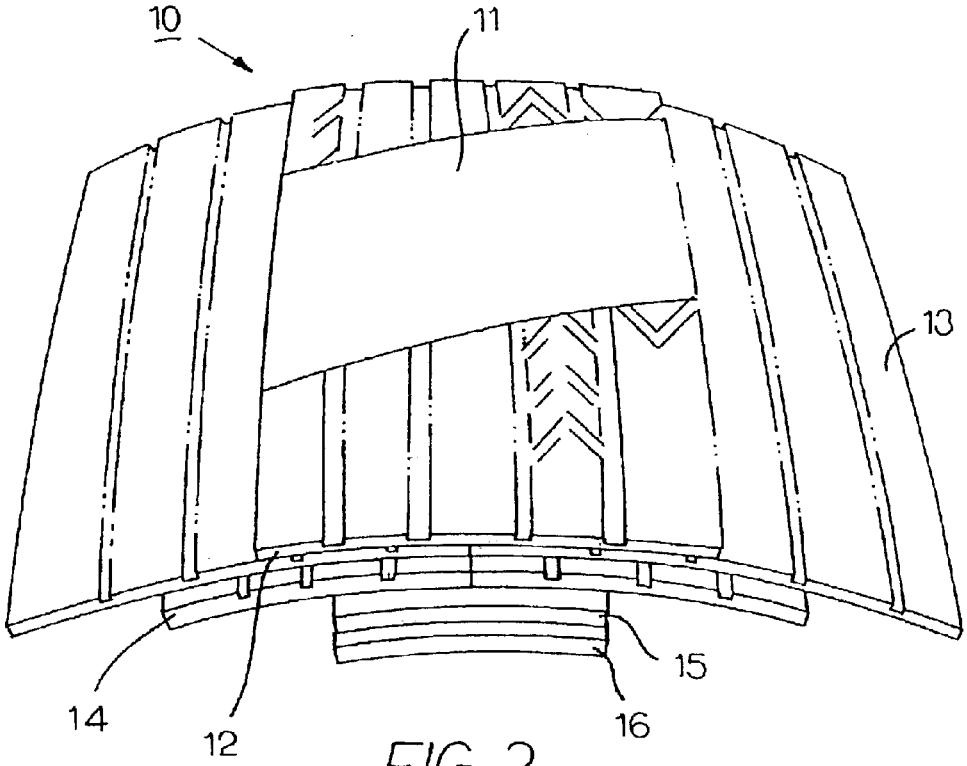
FIG. 2 is a perspective end view of a speed bump configuration, similar to that of FIG. 1, with several curved rubber strip layers of appropriate widths being stacked to a designated speed bump height.

In this configuration a phosphorescent layer 11 is disposed on the crown of the speed bump better seen in FIG. 2. The shorter crown top tire tread strip 12 and underlying longest strip 13 form resilient ingress and egress ramps that encounter oncoming vehicle tires. The stacked foundation layers 14, 15, 16 (etc.) establish the speed bump unit height.

The speed bump layers are fastened together in this embodiment by nails 17, 18, etc. appropriately patterned along the length and width of the speed bump. The nail heads 19 are embedded to prevent damage to oncoming vehicle tires. Alternatively the strips may be fastened together with an adhesive such as provided by MMM branded products.

The layered strips may be held in a suitable frame for nailing the assembly of layers together. To better protect against any possibility of nail damage to any overpassing vehicle tires, the crown layer 12 may be adhesively attached.

Longer fastener rods 21 extend through appropriate apertures in the stack of layers along the length of the speed bump to extend into the roadway surface 20 at 22 thus securing the speed bump removably in place. The rods have recessed heads 21, and preferably bolt or screw threads 22, which may be secured to either asphalt or concrete roadways having mating reception threads or apertures for producing non-destructive removal of the speed bump unit for reuse.

FIG. 2 shows a fragmental perspective end view of this illustrated embodiment.

Figure 3:
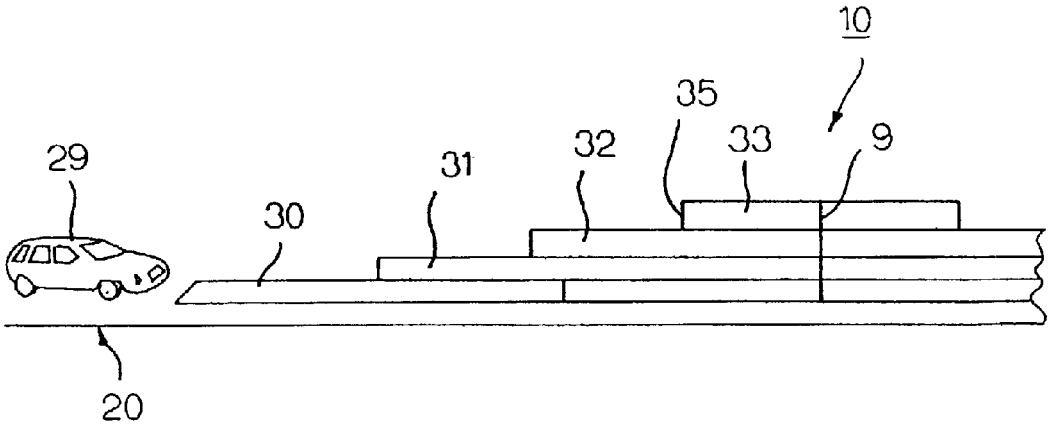
FIG. 3 is a foreshortened end view sketch of a speed bump embodiment having several flat pyramided rubber strip layers forming a speed bump unit of designated height.

FIG. 3 shows a further foreshortened speed bump unit embodiment sketch of a series of the flexible rubber strip layers 31–33 pyramided upon the roadway surface 20 to form the speed bump unit. The leading edges 35 of the respective layers may have a yellow phosphorescent coating for visibility from the oncoming vehicle 29. The flexible rubber strips individually encountered in this embodiment have the advantage of giving an aural warning rumble, and thus the height of the unit need not be excessive. The height of the speed bump is determined by the number of layers. Its width is formed by side by side strips meeting at joints 9.

With reclaimed tire carcasses there is a rounded shoulder on the sides that retains its molded shape to thus prevent the strips from lying flat. Thus narrower tire tread strips are cut from the center of the carcass crown inside the carcass shoulders, typically of three, four or five inches width, which have a propensity to lie flat on and substantially parallel to a road surface (20) and thus can be stacked in multiple layers in the flat pyramided layer construction of this embodiment.

Figure 4:
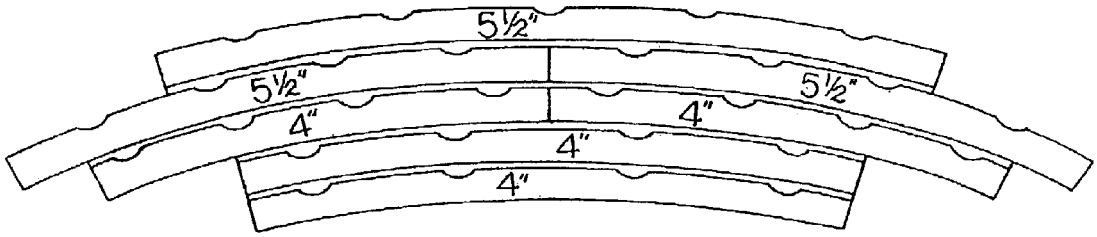
FIG. 4 is an end view sketch of a preferred embodiment pattern of stacked rubber strip layers forming a crowned speed bump unit intermediate inclined ingress and egress, wherein two intermediate layers are formed of side-by-side strips of similar widths.

In the configuration of FIG. 4, the five illustrated stacked strip layers are nailed, vulcanized or adhesively cemented together to form the speed bump unit having an uppermost crown with inclined ingress and egress edges. Typical adhesives include 3M brand Double coated polyethylene foam tapes, 3M Fastbond brand water-based adhesives and ON-HAND ADHESIVES, INC. hot melt adhesives. The two wider strip layers just below the uppermost crown strip are formed of two side-by-side strips of common width respectively designated with widths of five and a half inches and four inches wide. Thus when the strips are formed together into the speed bump unit, inclined ingress and egress edges are formed culminating in the single upper crown strip layer of five and a half inches width. This unit is secured removably to the road surface by mounting bolts of the nature before described or by the 3M brand double coated polyethylene foam tapes, supra.

With the resilient impact surface structure afforded by the before described speed bumps of this invention, and in particular with the flexible impact surfaces afforded by steel belted tire carcass strips, longer wear life with little catastrophic deterioration occurs particularly in the presence of heavy truck vehicles traveling at high speeds.

Accordingly this invention has provided improved speed bumps with novel basic materials that resolves various problems of the prior art and which nevertheless can be made at lower cost. Those features of novelty embodying the nature and spirit of this invention are thus set forth in the following claims.

What is claimed is:

1. A speed bump for intercepting the path of vehicles moving there over comprising in combination a stacked assembly of a plurality of flexible elongated rubber strip layers affixed together to form a speed bump unit for positioning upon and fastening to a roadway surface to intercept the tires of over passing moving vehicles characterized by an uppermost crown extending upwardly from said roadway surface to jolt the moving vehicles upwardly as they move there over, said crown being positioned between inclined ingress and egress edge regions extending gradually downwardly from the crown to the roadway surface, wherein the rubber strip layers are reclaimed from abandoned tire carcasses, comprising tire tread strips stacked in several curved rubber strip layers to form a speed bump configuration presenting said uppermost crown between said inclined ingress and egress edge regions at leading and trailing speed bump edges extending downwardly to the roadway surface.

* * * * *